US005935273A

United States Patent [19]

Kruger et al.

[11] Patent Number: 5,935,273

[45] Date of Patent: Aug. 10, 1999

[54] PROCESS FOR CONTINUOUS DYEING OF CELLULOSE-CONTAINING YARN WITH INDIGO IN A SINGLE APPLICATION WHILE CONTROLLING THE PH VALUE

[76] Inventors: Rudolf Kruger, Sudtiroler Ring 5, D-67273 Weisenheim; Franz Sutsch, Hauptstrasse 159, D-67127 Rodersheim-Gronau, both of Germany

[21] Appl. No.: 09/018,813

[22] Filed: Feb. 4, 1998

[30] Foreign Application Priority Data

Feb. 8, 1997 [DE] Germany ..... 197 04 797

[51] Int. Cl.[6] ..... D06P 1/22

[52] U.S. Cl. ..... 8/474; 8/653; 8/918

[58] Field of Search ..... 8/653, 930, 474, 8/918

[56] References Cited

U.S. PATENT DOCUMENTS

| | | | |
|---|---|---|---|
| 3,457,022 | 7/1969 | Fields | 8/653 |
| 4,536,907 | 8/1985 | Zumbrunn et al. | 8/149.1 |
| 4,845,789 | 7/1989 | Morton et al. | 8/150 |
| 5,295,998 | 3/1994 | Merritello et al. | 8/474 |

FOREIGN PATENT DOCUMENTS

| | | |
|---|---|---|
| 1098258 | 3/1981 | Canada . |
| 196 29 985 | 2/1997 | Germany . |

OTHER PUBLICATIONS

Fox, M.R *Vat Dyestuffs and Vat Dyeing*, John Wiley and Sons Inc, New York, pp. 80–88, 1947.

*Primary Examiner*—Margaret Einsmann
*Attorney, Agent, or Firm*—Kennedy, Covington, Lobdell & Hickman, LLP

[57] ABSTRACT

A process for continuous dyeing of cellulose-containing yarn with indigo in a single passage applies reduced indigo from an aqueous dye liquor containing deoxidants, alkali and a dissolved alkali metal salt at a concentration of 100 to 200 g/l as an electrolyte at a pH value of the liquor adjusted to about 10.2 to 11.3, while maintaining the electrolyte concentration, exposing the yarn to a gas which dissolves in the aqueous medium while forming an acid, and then oxidizing reduced indigo in the yarn to form pigment and finishing the dyeing process in a customary manner.

12 Claims, No Drawings

PROCESS FOR CONTINUOUS DYEING OF CELLULOSE-CONTAINING YARN WITH INDIGO IN A SINGLE APPLICATION WHILE CONTROLLING THE PH VALUE

FIELD OF THE INVENTION

The instant invention relates to a novel process for continuous dyeing of cellulose-containing yarn with indigo in a single application, i.e., a single passage through a vat of dye liquor.

BACKGROUND OF THE INVENTION

Dyeing of cellulose-containing textile materials with vat dyes is generally known. In order to lend the required substantivity to the vat dye, which is insoluble in water, i.e. in order to fix it on the textile material, it is first necessary to convert it into its substantive water-soluble leuco form by reduction (vatting) and thereafter back into dyestuff pigment by oxidation.

In their leuco form, most vat dyes are distinguished by a high affinity to the fibers and therefore by high dye bath exhaustion of approximately 70 to 95%. In contrast thereto, leucoindigo is only absorbed by the fiber to approximately 10 to 20% in a single dyeing process. Because of this low dye bath exhaustion, dyeing with indigo by means of a discontinuous exhaustion process (dyeing from the bath) is problematical.

It is therefore customary to perform dyeing with indigo continuously "in several passages". This process only permits dyeing of yarn in the form of tows or as a warp sheet, but not dyeing of piece goods or yarn packages. With this process, the vatted indigo from several (mostly five or six) dye liquors of large volume with a low dyestuff concentration is applied by means of repeated, short (approximately 10 to 20 seconds) dye application by dipping the yarn through multiple dye vats and squeezing and oxidizing in the interposed air spaces between the dipping steps. However, dyeing in passages is considered to be only a stopgap measure, since it requires uneconomically large dyeing machinery and smaller dye batches cannot be realized. Furthermore, the repetition of the dyeing process results in extensive dyestuff penetration of the textile material so that, particularly with dark colors, extremely ring-dyed warp thread employed in jeans production, which is a prerequisite for generating the "stone-washed" effect in washing ofjeans, can only be obtained to an unsatisfactory degree.

A further problem when dyeing with indigo is that, because of the low dye bath exhaustion, the coloration obtained has only insufficient crocking fastness, since the dyestuff having remained in the gap volume is precipitated on the textile material after oxidation and is not fixed.

In the dyeing process described in prior German patent application 196 29 985.3, the substantivity of the leucoindigo is increased by performing dyeing at very high electrolyte concentrations (preferably approximately 280 g/l of dye liquor) and at pH values reduced (in comparison with conventional vat dyeing) to 10.2 to 11.3.

OBJECT AND SUMMARY OF THE INVENTION

It is accordingly an object of the present invention to provide a more advantageous process for continuous dyeing of cellulose-containing yarn with indigo, which remedies the above mentioned shortcomings of conventional techniques, by means of which dark colors can also be dyed with satisfactory crocking fastness and ring-dyed yarn can be produced.

In accordance with the present invention, cellulose-containing yarn may be continuously dyed with indigo in a single passage by a process which applies to the yarn the reduced indigo from an aqueous dye liquor containing deoxidants (also known in the art as deoxidizers), alkali and additionally a further dissolved alkali metal salt at a concentration from 100 to 200 grams per liter (g/l) as the electrolyte and whose pH value has been adjusted to 10.2 to 11.3. While maintaining the electrolyte concentration of the dye, the yarn is subjected to a gas which is dissolved in the aqueous medium while forming an acid, and the reduced indigo applied to the fiber is reoxidized to a pigment while maintaining the electrolyte concentration and dyeing is completed in the customary manner.

An essential characteristic of the process in accordance with the present invention is that after the dye liquor has been applied, the yarn is subjected to a gas which develops an acid in an aqueous solution and causes the pH value of the fiber to be lowered (as a rule by one to two pH units) and therefore the solubility of the leucoindigo is reduced and its substantivity increased. Suitable for this purpose are inorganic gases, such as carbon dioxide and hydrogen chloride as well as organic gases, such as formic acid vapor and acetic acid, however, carbon dioxide is particularly preferred. The presence of oxygen (or air) during the action of these gases should be prevented. Inert gases, such as nitrogen, can be present as carriers for these gases, but when employing carbon dioxide, this is generally not necessary. As a rule, the acid-forming gas is permitted to act on the aliquor-dampened yarn 5 seconds to 5 minutes, preferably approximately 0.5 to 1 minute.

A further important characteristic of the process in accordance with the present invention is that a dye liquor with a comparatively high electrolyte concentration of from 100 to 200 g/l is used. It would of course also be possible to employ yet higher concentrations of up to approximately 300 g/l, however, in general this is not required.

Essentially neutral alkali metal salts are primarily suitable as the electrolyte, which are sufficiently soluble in water in order to provide the desired concentration of dissolved electrolyte. Examples of salts suitable for this purpose are inorganic and organic sodium salts, such as sodium chloride, sodium nitrate, sodium sulfate, sodium phosphate, sodium acetate and sodium formiate, with sodium chloride being preferred.

In this process, it is important that the electrolyte concentration is maintained until the reoxidation of the reduced dyestuff into a pigment. This can be accomplished in a simple manner in that the moist yarn obtained after the removal of the dye liquor, which still contains a sufficient amount of electrolyte, is first treated with the acid-forming gas and is then taken to the oxidation process without prior rinsing.

It is furthermore important in the method of the present invention that the pH value of the liquor be set to a comparatively low pH value of, as a rule, 10.2 to 11.3, preferably 10.8 to 11.1. For example, this can be advantageously achieved by using sodium carbonate as the alkali in place of the otherwise customary use of sodium hydroxide.

By means of the described measures in accordance with the present invention, such a great increase in the substantivity of the indigo is achieved, that more than 95% of the vatted indigo is absorbed by the textile fiber already after a single dye application (in one dipping passage through a dye vat).

It is practical in connection with the application of the dye process in accordance with the present invention to proceed by placing the indigo in pre-reduced form in the aqueous liquor containing deoxidants, alkali and additional electrolyte, or by adding the indigo in portions or continuously to this liquor during dipping of the yarn. Suitable for this purpose are, for example, the so-called "stock vats", i.e. the leucoindigo solutions prepared in an upstream connected container by reduction with sodium dithionite in the presence of sodium hydroxide at an increased temperature, and primarily alkali-aqueous leucoindigo solutions such as are obtained in the course of catalytic hydrogenation of indigo. In general, these solutions contain 10 to 35 weight-percent of leucoindigo and 2 to 10 weight-percent of alkali.

When employing pre-reduced indigo, it is only necessary to again reduce indigo which may have been reoxidized by an unwanted entry of air. Thus, the dye liquor customarily contains only 0.5 to 1.5 g/l of deoxidant, wherein preferably sodium dithionite is used as the deoxidant.

In order to increase the ability of the yarn to carry liquor, it is recommended to add a lubrication and thickening agent to the dye liquor. Polymers with polar groups on the basis of acrylate are suitable for this purpose.

It is of particular advantage in accordance with the invention that it is possible to dye the yarn (in the form of a tow or as a warp sheet) at a short dyebath ratio (as a rule 1:20). In this case, it is possible to either operate with a relatively long dipping time (approximately 1 minute) and therefore an almost exhausted dye liquor, or with a relatively short dipping time (approximately 1 to 5 seconds) and a leucoindigo concentration which is kept constant. The treatment with the acid-forming gas can advantageously be performed in a downstream connected fixing zone (approximately 1 minute).

The exhausted dye liquor can again be used for dyeing, following restocking with leucoindigo and replenishing the deoxidants, alkali and electrolyte, as well as any lubricating and thickening agents, if required.

In a preferred embodiment of the process in accordance with the present invention, prior to the application of the leucoindigo, the yarn is pre-impregnated with a pre-wetting liquor already containing alkali and electrolyte. The pre-wetting liquor is preferably heated to 60° to 95° C. for this step. Following this pre-treatment, the yarn is customarily squeezed and cooled in a following air space. By means of this procedure, it is possible to obtain particularly extreme ring dyeing. Furthermore, a pretreatment of the yarn for increasing wettability can be omitted.

The final oxidation of the applied leucoindigo to form a pigment is performed without prior rinsing of the yarn and advantageously takes place in air. The completion of the dyeing process can take place in the customary way by rinsing and neutralization, if required. Washing and soaping processes can be performed thereafter.

By means of the process in accordance with the present invention, it is possible to continuously dye cellulose-containing yarn in the form of a tow or a warp sheet advantageously and dependably with a high quality. The colorations obtained are distinguished by their high degree of crocking fastness and evenness, it is also possible to obtain dark (in general up to 2 to 3%) colorations without problems. The process of the present invention is particularly distinguished in that extremely ring-dyed warp yarn can be easily obtained, which permits a quick wash down during jeans washing. In addition, it is possible to perform dyeing in only one application or passage and with a short liquor ratio, which makes the replacement of dyeing ranges by more compact dyeing machines possible. The process in accordance with the invention of course not only makes dyeing with indigo alone possible, but also with mixtures of indigo and other vat dyestuffs, for example yellow or red ones, which are used for obtaining nuances in shades.

DETAILED DESCRIPTION OF THE PREFERRED EMBODIMENTS

The above-described features, principles, characteristics and advantages of the present invention are further explained and described and will be further understood, with reference to several exemplary embodiments of the present process set forth below.

EXAMPLE 1

Continuous Warp Yarn Dyeing in the Form of Warp Sheets (Slasher)

A warp comprised of cotton warp yarns each of an international yarn count Nm. 12 (12 kilometers per kilogram (km/kg) of yarn) with 4080 individual such yarns in the warp, was prepared. The cotton warp yarns were transported at a traveling velocity of 30 meters per minute (m/min), which corresponded to a yarn throughput of 10.2 kilograms per minute (kg/min). The batch length of the warp was approximately 30,000 meters.

Prior to the application of the reduced indigo, the dry warp sheet was impregnated with a hot pre-wetting liquor (at a temperature of approximately 92° C.), containing 150 grams per liter (g/l) of sodium chloride, and 20 g/l of anhydrous sodium carbonate. The prewetted warp yarn sheet was then squeezed to obtain a liquor application of approximately 60% and cooled by travel in a subsequent air space. In the process, the pre-wetting liquor was maintained at a constant fill level by means of an automatic replenishment control from a reservoir.

The viscous dye liquor was prepared containing:

150 grams per liter (g/l) of sodium chloride, 20 g/l of anhydrous sodium carbonate, 30 g/l of a 20 weight-percent alkali-aqueous leucoindigo solution (4.8 weight-percent sodium hydroxide, a commercial product of BASF), 1 g/l of sodium dithionite (88%), and 30 g/l of a lubricating and thickening agent.

This viscous dye liquor was applied to the pre-wetted warp yarn sheet in a padding machine with very soft squeezing rollers and with an economy volume vat with a liquor content of approximately 80 liters at a dipping time of approximately 2 seconds and a liquor application of approximately 250%, i.e. a liquor addition of 190%.

The outlet of the padding machine was designed such that, immediately after squeezing of the warp sheet and without contact with the air, the warp sheet entered an oxygen-free dwelling chamber containing a pure carbon dioxide atmosphere and fixed yarn guidance, in which the warp sheet was retained for approximately 60 seconds at room temperature for dyestuff fixation and pH value reduction.

After leaving the dwelling chamber, the warp sheet was squeezed in a second padding machine to a liquor application of approximately 80%. The dyestuff-poor squeezing liquor was collected and returned to the dye vat after adjusting the desired viscosity and replenishing the leucoindigo, alkali, electrolyte and sodium dithionite.

The fixed leucoindigo in the yarns of the warp sheet was oxidized to form pigment during transport of the warp sheet in the air space following the dwelling chamber, taking approximately 60 seconds. Subsequently, approximately 85% of the exhausted liquor still contained in the warp sheet was rinsed out with little water. The washing liquor was collected for reuse as pre-wetting liquor and transferred into a reservoir. Following rinsing, the warp sheet was pre-dried on cylinder dryers prior to the application of a sizing agent.

The resultant cotton warp yarn contained 1.1% indigo of an extreme ring dye coloration.

EXAMPLE 2

Continuous Warp Yarn Dyeing in Tow Form (Rope)

Cotton warp yarn of yarn count Nm. 12, was prepared for dyeing in the form of twelve separate tows (ropes), each of 340 individual yarn ends or threads. The traveling velocity of the tows was 25 meters per minute (m/min), corresponding to a yarn throughput of 8.5 kilograms per minute (kg/min). The batch length was approximately 30,000 meters.

Analogous to Example 1 above, the dry tows were initially impregnated with a hot pre-wetting liquor prior to the application of the reduced indigo, squeezed to 60% liquor application and cooled in a following air space.

The subsequent application of the viscous dye liquor, which was composed the same as in Example 1, took place in a padding machine with very soft squeezing rollers and in a dye vat provided with several reversing rollers in a dipping passage with a liquor application of approximately 250%, i.e. a liquor addition of 190%, while reusing the squeeze liquor.

The padding machine outlet was constructed such that the tows dwelled in a following slide for approximately 60 seconds, with atmospheric oxygen excluded and in a carbon dioxide atmosphere, during which time the pH value was lowered and the dyestuff was fixed.

Following the exit from the dwelling slide, further operations took place analogously with Example 1: the tows were squeezed to 80% liquor application, the fixed leucoindigo was oxidized to form pigment, and dyeing was completed by rinsing (reusing the rinsing liquor) and drying the tows.

The resultant cotton warp yam contained 1.1% indigo of an extreme ring dye coloration.

EXAMPLE 3

Continuous Warp Yarn Dyeing in a Dyeing Tube (Pipe Dyeing)

Cotton warp yarn of yarn count Nm. 12 was prepared for dyeing in the form of twelve separate tows (ropes), each of 340 individual yarn ends or threads. The traveling velocity of the tows was 25 meters per minute (m/min), corresponding to a yarn throughput of 8.5 kilograms per minute (kg/min). The batch length was approximately 30,000 meters.

Analogous to Example 1 above, the dry tows were initially impregnated with a hot prewetting liquor prior to the application of the reduced indigo, squeezed to 60% liquor application and cooled in a following air space.

The dye liquor was prepared to contain:

150 grams per liter (g/l) of sodium chloride, 20 g/l of anhydrous sodium carbonate, 10 g/l of a 20 weight-percent alkali-aqueous leucoindigo solution (4.8 weight-percent sodium hydroxide, a commercial product of BASF), and 1 g/l of sodium dithionite (88%).

The prepared dye liquor was applied to the individual tows by directing the respective tows to travel from the preceding air space into individual separate dyeing tubes, i.e. the dyeing portion of the installation consisted of 12 dyeing tubes, each of a dipping length of 25 meters. By means of a dye circulation system, the dyeing tubes were provided with fresh dye liquor such that identical flow conditions at the same dyestuff concentration existed in the individual tubes. The tows and the liquor moved in the same direction, however, the tows moving at twice the speed of the liquor. The ratio of throughput yarn and liquor was 1:8.

After passing through one-half of the distance through the tubes, carbon dioxide gas was introduced into each dyeing tube in order to convert the soda-alkaline milieu into a bicarbonate-alkaline one. To this end, the dyeing tube was upwardly inclined over its entire length.

After being retained in the dyeing tubes, the tows were squeezed in a padding machine under high pressure to a liquor application of approximately 80%, i.e. approximately 90% of the exhausted dye liquor carried along with the tows was removed. The dyestuff-poor squeezing liquor was collected and returned to the circulation system after replenishing the leucoindigo, alkali, electrolyte and sodium dithionite.

Subsequently the fixed leucoindigo was oxidized to form pigment analogously to Example 1, and dyeing was finished as in Example 1 by rinsing (reusing the rinsing liquor) and drying.

The resultant cotton warp yarn contained 1.6% of indigo of a good ring dye coloration.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A process for continuous dyeing of cellulose-containing yarn with indigo in a single dye application, comprising the steps of preparing reduced indigo in a dye liquor comprised of an aqueous medium containing a deoxidizer, an alkali and a dissolved neutral alkali metal salt at a concentration of about 100 to 200 grams per liter (g/l) as an electrolyte; adjusting the pH value of the dye liquor to between about 10.2 and 11.3; applying the dye liquor to a cellulose-containing yarn, while maintaining the electrolyte concentration; after applying the dye liquor to the cellulose-containing yarn exposing the yarn to a gas which dissolves in the aqueous medium to form an acid; after exposing the yarn to a gas which dissolves in the aqueous medium to form an acid, oxidizing the reduced indigo applied to the yarn to form pigment; and, after oxidizing the reduced indigo applied to the yarn to form pigment, finishing the dyeing of the yarn.

2. The process in accordance with claim 1, wherein the gas which dissolves in the aqueous medium to form an acid comprises carbon dioxide.

3. The process in accordance with claim 1, wherein the electrolyte comprises sodium chloride.

4. The process in accordance with claim 1, wherein the alkali comprises sodium carbonate.

5. The process in accordance with claim 1, wherein the alkali comprises a mixture of sodium hydroxide and sodium hydrogen carbonate.

6. The process in accordance with claim 1, wherein the deoxidizer comprises sodium dithionite.

7. The process in accordance with claim 1, wherein the preparation of the reduced indigo comprises adding pre-reduced indigo to the dye liquor.

8. The process in accordance with claim 1, wherein the dyebath ratio is 1:20.

9. The process in accordance with claim 1, further comprising the step of, prior to applying the dye liquor, impregnating the yarn with an aqueous liquor containing an alkali and a dissolved neutral alkali metal salt in a concentration of 100 to 200 g/l as an electrolyte, and having a pH value of about 10.2 to 11.3.

10. The process in accordance with claim 1, wherein the yarn is prepared for dyeing in the form of a tow.

11. The process in accordance with claim 1, wherein the yarn is prepared for dyeing in the form of a warp sheet.

12. The process in accordance with claim 1, wherein the yarn is dyed as a ring-dyed warp yarn.

* * * * *